US008144099B2

(12) United States Patent
Kojima et al.

(10) Patent No.: US 8,144,099 B2
(45) Date of Patent: Mar. 27, 2012

(54) OCB-MODE LIQUID CRYSTAL DISPLAY APPARATUS WITH INITIAL TRANSITION OF OCB LIQUID CRYSTAL

(75) Inventors: Tetsuya Kojima, Ishikawa (JP); Tetsuo Fukami, Ishikawa (JP); Kazuhiro Nishiyama, Ishikawa (JP); Kenji Nakao, Ishikawa (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 826 days.

(21) Appl. No.: 12/032,434

(22) Filed: Feb. 15, 2008

(65) Prior Publication Data

US 2008/0198124 A1 Aug. 21, 2008

(30) Foreign Application Priority Data

Feb. 15, 2007 (JP) ..... 2007-035379
Jan. 7, 2008 (JP) ..... 2008-000600
Feb. 8, 2008 (JP) ..... 2008-029133

(51) Int. Cl.
*G09G 3/36* (2006.01)

(52) U.S. Cl. ..... 345/96; 345/94; 345/99

(58) Field of Classification Search ..... 345/87–104
See application file for complete search history.

(56) References Cited

U.S. PATENT DOCUMENTS 6,486,864 B1 * 11/2002 Nakajima et al. ..... 345/92
2004/0041766 A1 * 3/2004 Nakao et al. ..... 345/89
2006/0274011 A1 * 12/2006 Igarashi et al. ..... 345/94

FOREIGN PATENT DOCUMENTS

JP 2001-083552 3/2001
JP 2003-107506 4/2003
KR 2006-39873 5/2006

OTHER PUBLICATIONS

U.S. Appl. No. 12/236,868, filed Sep. 24, 2008, Nakao, et al.

* cited by examiner

*Primary Examiner* — Bipin Shalwala
*Assistant Examiner* — Ryan A Lubit
(74) *Attorney, Agent, or Firm* — Oblon, Spivak, McClelland, Maier & Neustadt, L.L.P.

(57) ABSTRACT

There is provided an liquid crystal display apparatus configured to invert a pixel voltage and a common voltage on a frame to frame basis while setting a transition voltage Vt in such a manner that the polarity of the pixel voltage to be applied to a pixel electrode of each display pixel and the polarity of the common voltage to be applied to a common electrode of a common substrate are differentiated.

12 Claims, 15 Drawing Sheets

OCB-MODE LIQUID CRYSTAL DISPLAY APPARATUS WITH INITIAL TRANSITION OF OCB LIQUID CRYSTAL

CROSS-REFERENCE TO RELATED APPLICATIONS

This application is based upon and claims the benefit of priority from the prior Japanese Patent Application No. 2007-35379, filed on Feb. 15, 2007 and the prior Japanese Patent Application No. 2008-600, filed on Jan. 7, 2008; the entire contents of which are incorporated herein by reference.

TECHNICAL FIELD

The present invention relates to a liquid crystal display apparatus in an OCB (Optically Compensated Bend) mode.

BACKGROUND OF THE INVENTION

In the liquid crystal display apparatus in the OCB mode, since the initial state of OCB liquid crystal is different from a bend alignment at the time of displaying and is, for example, a splay alignment, it is necessary for transition of the alignment to a bend alignment to display images while maintaining the state of transition to the bend alignment.

In order to ensure this initial transition, a liquid crystal display apparatus in which transition nucleuses for ensuring and speeding up the transition are provided in respective display pixels is proposed in the related art (for example, see Japanese Application Kokai 2003-107506). The initial transition is promoted respectively in the transition nucleus in each pixel, for example, by applying a lateral electric field to the OCB liquid crystal.

In the liquid crystal display apparatus in the OCB mode as described above, a time required for the initial transition when the power is ON (hereinafter referred to as "initial transition time") depends significantly to the panel temperature or the transition voltage of a liquid crystal panel.

The initial transition time increases with decrease in transition voltage as shown in FIG. 17, and increases with lowering in panel temperature as shown in FIG. 18.

Referring to FIG. 19, a case of applying a transition voltage Vt in the initial transition time in the related art will be described in detail. An example of so-called a dot inversion drive, in which the polarity of a pixel voltage Vp is inverted with respect to a constant common voltage Vcom so that the polarities of the voltages to be applied to the liquid crystal is different from the adjacent pixels when displaying the image will be described.

The polarity of the common voltage Vcom is inverted between negative and positive with reference to 0V as a reference potential every certain period, for example, on a frame to frame basis for applying a high voltage.

The pixel voltage Vp of the pixel electrode at each pixel is inverted according to the dot inversion drive when displaying the image. In this case, as shown in FIG. 19, the transition voltage Vt applied to the OCB liquid crystal varies from a pixel to pixel basis according to the polarity inversion of the pixel voltage Vp in each frame. Consequently, an integration value of the electric potential difference between the pixel electrode and a common electrode cannot be set to a large value, so that a sufficient transition voltage Vt cannot be secured as described above, and hence the initial transition time is increased.

In view of such problems described above, it is an object of the present invention to provide a liquid crystal display apparatus in an OCB mode in which reduction of an initial transition time is enabled.

BRIEF SUMMARY OF THE INVENTION

According to embodiments of the invention, there is provided a liquid crystal display apparatus including an array substrate having a plurality of pixel electrodes in a matrix; a common electrode opposing the pixel electrode; a display panel having an OCB liquid crystal sandwiched between the pixel electrode and the common electrode, and a drive circuit configured to apply a pixel voltage in one of a positive pixel voltage range on the side of the positive polarity and a negative pixel voltage range on the side of the negative polarity with respect to a first reference voltage to the pixel electrode, and selectively apply one of a positive common voltage on the side of the positive polarity with respect to a second reference voltage and a negative common voltage on the side of the negative polarity to the common electrode, in which the drive circuit applies the positive common voltage to the common electrode, applies a pixel voltage selected from the negative pixel voltage range except for the highest voltage to the pixel electrode, applies the negative common voltage to the common electrode, and applies a pixel voltage selected from the positive pixel voltage range except for the lowest voltage to the pixel electrode, thereby achieving initial transition of the OCB liquid crystal from a splay alignment to a bend alignment.

According to the embodiments of the invention, there is provided a liquid crystal display apparatus including an array substrate having a plurality of pixel electrodes in a matrix; a common electrode opposing the pixel electrode; a display panel having an OCB liquid crystal sandwiched between the pixel electrode and the common electrode, and a drive circuit configured to apply a pixel voltage in one of a positive pixel voltage range on the side of the positive polarity and a negative pixel voltage range on the side of the negative polarity with respect to a first reference voltage to the pixel electrode, and selectively apply one of a positive common voltage on the side of the positive polarity with respect to a second reference voltage and a negative common voltage on the side of the negative polarity to the common electrode, in which the drive circuit applies the positive common voltage to the common electrodes, applies a pixel voltage selected from the negative pixel voltage range except for the highest voltage to one of the pixel electrodes, applies a pixel voltage selected from the positive pixel voltage range except for the highest voltage to another one of the pixel electrodes which is adjacent to the one of the pixel electrodes, thereby achieving initial transition of the OCB liquid crystal from a splay alignment to a bend alignment.

According to the embodiments of the invention, an applied voltage between the pixel voltage and the common voltage during the initial transition may be set to a high voltage, so that the initial transition time may be reduced.

DETAILED DESCRIPTION OF THE INVENTION

Figure 1:
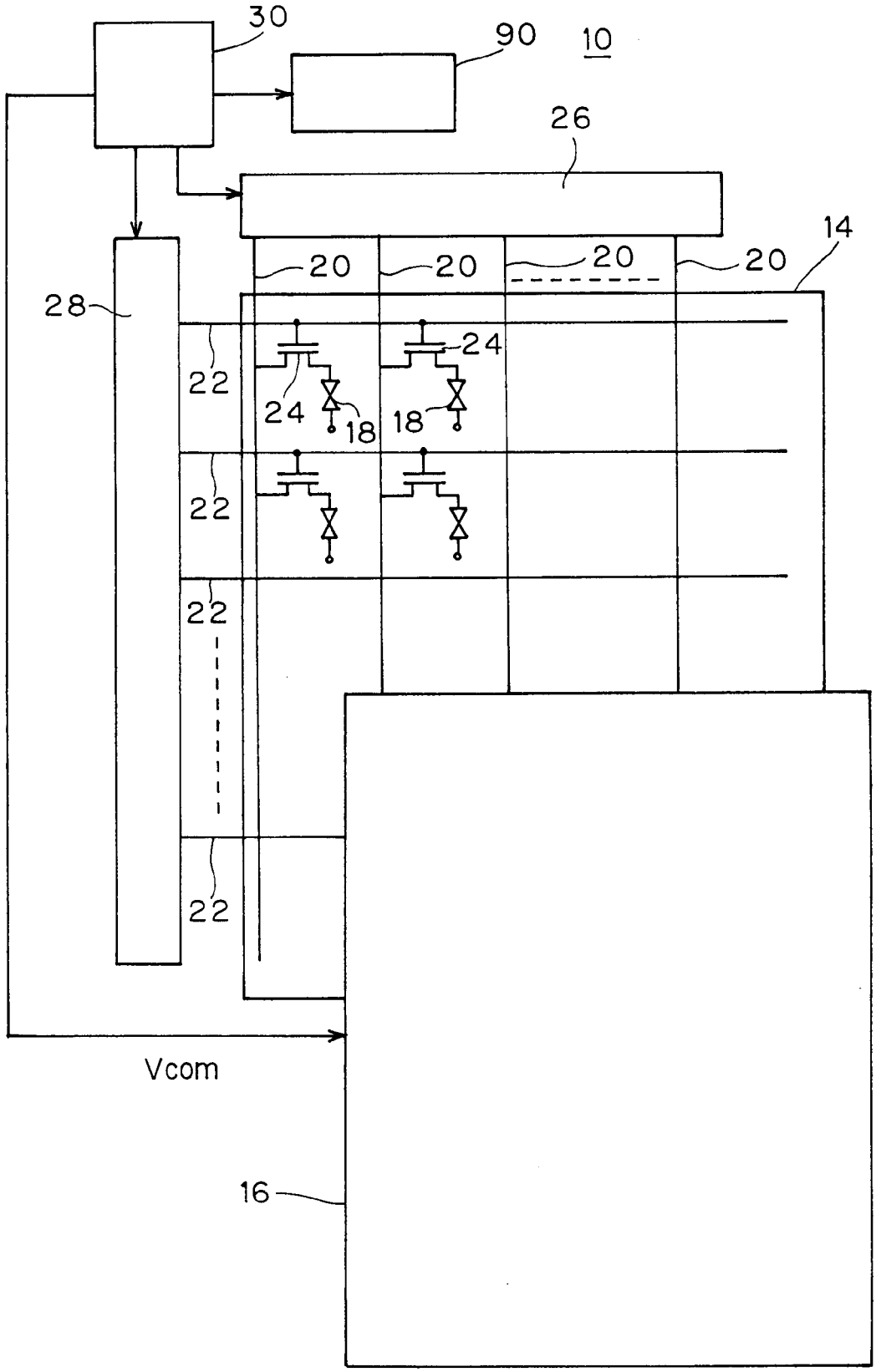
FIG. 1 is a schematic drawing showing a configuration of a liquid crystal display apparatus according to a first embodiment of the invention.

Referring now to the drawings, a liquid crystal display apparatus 10 in an OCB mode according to an embodiment of the invention will be described.

First Embodiment

Referring now to FIG. 1 to FIG. 5 and FIG. 13, the liquid crystal display apparatus 10 in the OCB mode according to a first embodiment will be described. The liquid crystal display apparatus 10 is configured into a light-transmitting type of a normally white mode (white when being applied with a zero or low voltage and black when being applied with a high voltage).

(1) Configuration of Liquid Crystal Display Apparatus 10

Referring to FIG. 1 to FIG. 5, a configuration of the liquid crystal display apparatus 10 will be described.

A liquid crystal panel 12 of the liquid crystal display apparatus 10 is of the OCB mode in which an OCB liquid crystal is sandwiched between an array substrate 14 and a common substrate 16.

Figure 2:
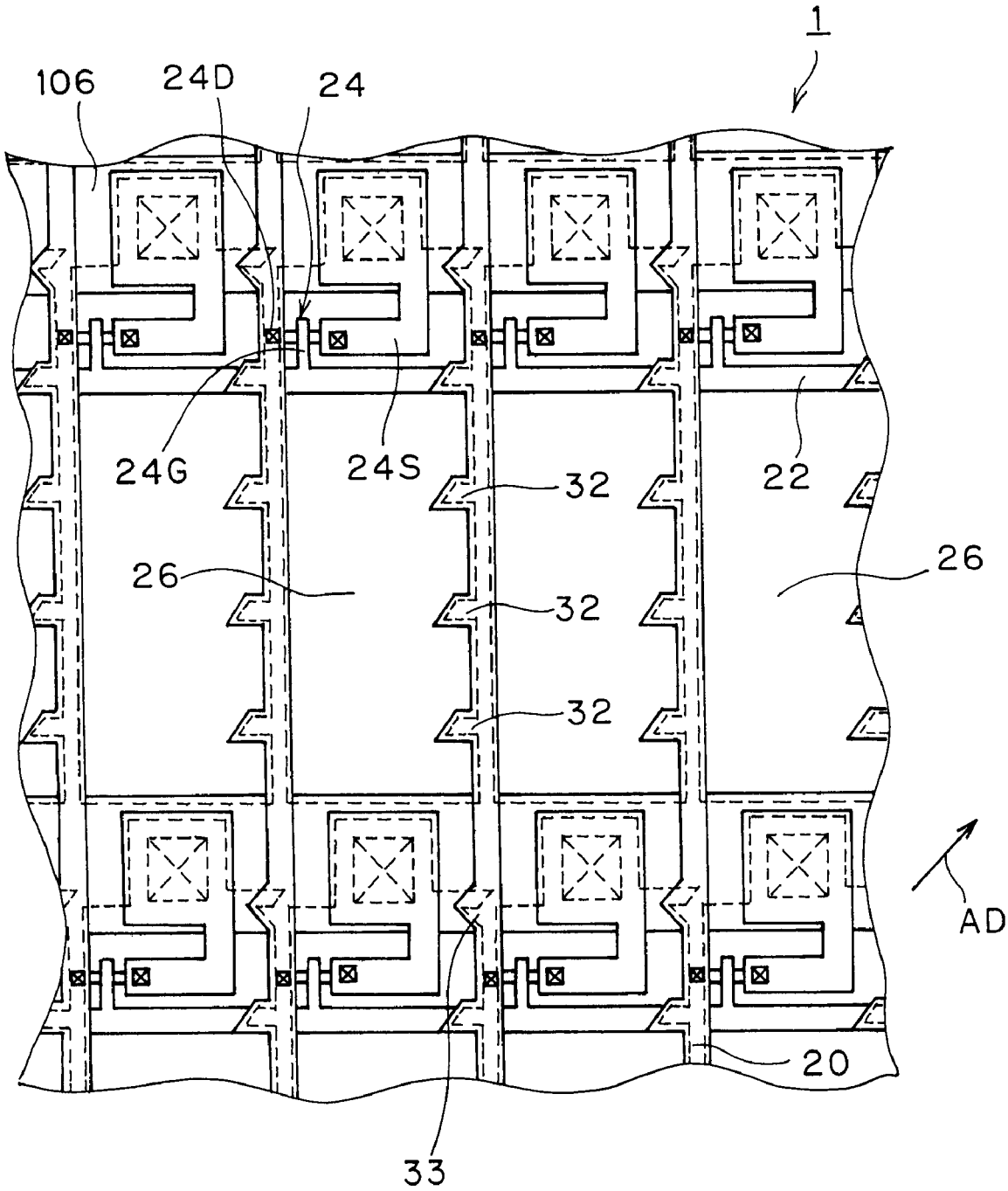
FIG. 2 is a plan view of an array substrate of the liquid crystal display apparatus according to the first embodiment.

As show in FIG. 1, a plurality of signal lines 20 extending in the vertical direction are wired on the array substrate 14, and a plurality of gate lines 22 extending in the lateral direction are wired so as to be orthogonal to the signal lines 20. Arranged near intersections of the signal lines 20 and the gate lines 22 are thin film transistors (hereinafter, referred to as TFT) 24. As shown in FIG. 2, the signal lines 20 are connected to drain electrodes 24D of the TFTs 24, the gate lines 22 are connected to gate electrodes 24G, and pixel electrodes 29 are connected to source electrodes 24S.

As shown in FIG. 1, a signal line driver circuit 26 is provided for supplying video signals to the plurality of signal lines 20, and a gate line driver circuit 28 is provided for supplying gate signals to the plurality of gate lines 22 respectively. In the first embodiment, the signal line driver circuit 26 and the gate lines driver circuit 28 are respectively configured with TCPs (Tape Carrier Packages) and are electrically connected to the array substrate 14 by an anisotropic conductive film. However, they may be connected to the array substrate 14 via COG (Chip on Glass) method or may be formed integrally therewith in the same process as the TFTs.

A controller 30 is connected to the signal line driver circuit 26 and the gate lines driver circuit 28. The controller 30 receives a supply of clock signals and video signals from the outside signal source. A power source, not shown, is connected to the controller 30, so that an initial transition is started in response to an entry from the external power source. Then, on the basis of the clock signals and the video signals entered from the outside signal source, horizontal clock signals CKH, horizontal start signals STH, digital video signals Data, polarity inverting signals POL are supplied from the controller 30 to the signal line driver circuit 26 at predetermined timings. Vertical clock signals CKV and vertical start signals STV are supplied to the gate lines driver circuit 28. The controller 30 outputs control signals for controlling ON and OFF of a back light 90.

The controller 30 is provided with a drive sequence which starts from turning ON of the power source, passes through the initial transition and reaches the image display integrated therein, and is provided with a dummy digital video signal Data for the initial transition stored in the internal memory. The dummy digital video signals Data for the initial transition is a black display video signal corresponding to the minimum value of a pixel voltage Vp within a negative pixel voltage range when a common voltage Vcom is a positive common voltage Vcom-p on the side of the positive polarity with reference to a reference common voltage and is a black display video signal corresponding to the maximum value of the pixel voltage Vp within a positive pixel voltage range when the common voltage Vcom is a negative common voltage Vcom-n on the side of the negative polarity with respect to the reference common voltage. An RGB color filter is provided on the common substrate 16 via a black matrix in a stripe pattern, and a common electrode and an alignment layer are laminated on the upper surface thereof. The common voltage Vcom is supplied to the common electrode on the common substrate 16 from the controller 30. An alignment layer 52 is laminated also on the upper surface of the pixel electrode 29. The alignment layer is rubbed in the direction indicated by an arrow AD in FIG. 2.

(2) Configuration of Transition Nucleus

Figure 3:
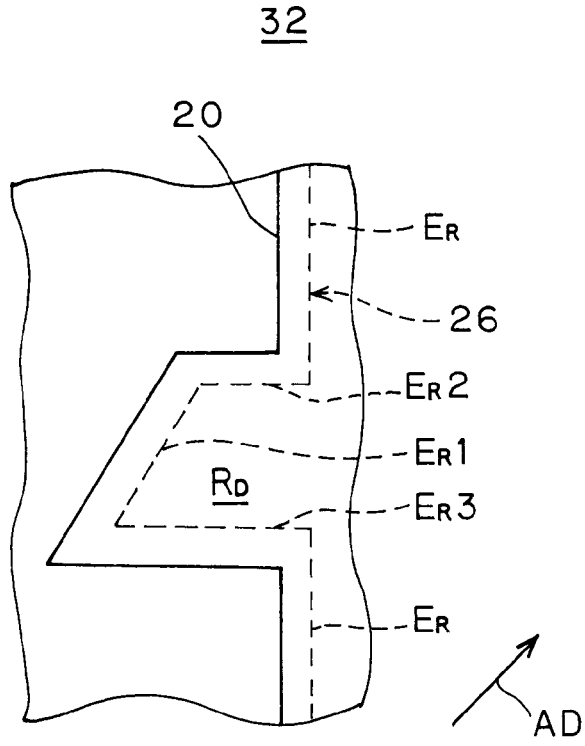
FIG. 3 is an enlarged drawing of a first transition nucleus in FIG. 2.
Figure 4:
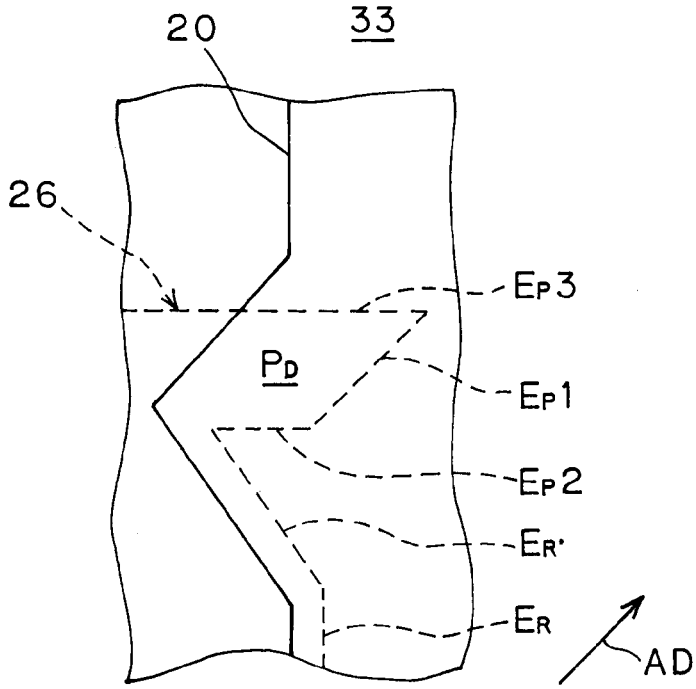
FIG. 4 is an enlarged drawing of a second transition nucleus in FIG. 2.

Each of the pixels in the first embodiment includes a first transition nucleus 32 and a second transition nucleus 33 for promoting the initial transition. Referring now to FIG. 2 to FIG. 4, the configuration of the transition nucleuses 32, 33 will be described.

FIG. 2 is a plan view of the array substrate 14, FIG. 3 is an enlarged view of the first transition nucleus 32 in FIG. 2 and FIG. 4 is an enlarged view of the second transition nucleus 33. The arrows AD in FIG. 2 to FIG. 4 indicate the rubbing direction of the alignment film as described above, and the direction indicated by the arrows corresponds to the downstream.

As shown in FIG. 2, the pixel electrodes 29 each are formed into a substantially rectangular shape, and three first transition nucleuses 32 and two second (2 sec.) transition nucleus 33 are provided on the right side of the respective pixel electrodes 29, that is, the position of the adjacent signal line 20.

The first transition nucleuses 32 are positioned at the downstream of the pixel electrodes 29 and have the following structure.

As shown in FIG. 2 and FIG. 3, the right edge ER of the pixel electrodes 29 is provided with a recess RD recessed from the right edge ER. The recess RD is formed with a first edge ER1 extending in the alignment direction AD on the downstream side, a second edge ER2 connecting the first edge ER1 to the right edge ER and directed upstream and a third edge ER3 connecting the first edge ER1 to the right edge ER and directed downstream.

The second transition nucleus 33 is positioned on the downstream side of the pixel electrodes 29 and has the following structure.

As shown in FIG. 2 and FIG. 4, there is also provided a projection PD projecting downstream from the right edge ER in an edged shape. Reference sign ER' designates a bent portion of the right edge ER. The projection PD is formed with a first edge EP1 extending in the alignment direction AD on the downstream side, a second edge EP2 connecting the first edge EP1 to the right edge ER and being oriented to the upstream side and a third edge EP3 connecting the first edge EP1 to the right edge ER and directed downstream.

(3) Effects of Transition Nucleus

Effects of the first transition nucleuses 32 and the second transition nucleus 33 as described above are described.

An electric field formed by the second edge ER 2 of the pixel electrode 29 causes the twist angle to be larger than the twist angle at the tip in the vicinity of the first edge ER 1. Therefore, a clockwise twist alignment exceeding 90 degrees in twist angle cannot be generated in the vicinity of the first edge ER1 and the second edge ER2.

When a twist alignment exceeding 90 degrees in twist angle is generated in a narrow area, distortion of the liquid crystal array remarkably increase the state energy in the tip area. The twist alignment is similar to a 180-degree twist alignment which is subject to transition to the bend alignment with ease. Therefore, splay-to-bent transition occurs easily.

The orientations of inclination of liquid crystal molecules in a plane vertical to the second edge ER2 are differentiated remarkably between an area in the vicinity of the second edge ER2 and an area above the pixel electrode 29 adjacent thereof. Accordingly, a disclination line DL is generated in the vicinity of the second edge ER2.

The disclination line DL and the area in the vicinity thereof have a high state energy although not as high as the area in which the twist alignment is formed described above. In addition, the disclination line DL and the area in the vicinity thereof is much larger than the area in which the twist alignment is formed described above, and these areas are adjacent to each other.

Therefore, when the transition to the bend alignment occurs in the area in which the twist alignment is formed, the area of the bend alignment expands quickly to the disclination line DL and the area in the vicinity thereof. Therefore, the splay to bend transition easily occurs in the area corresponding to the downstream portion of the pixel electrode 29.

(4) Operation of Liquid Crystal Display Apparatus 10

Figure 5:
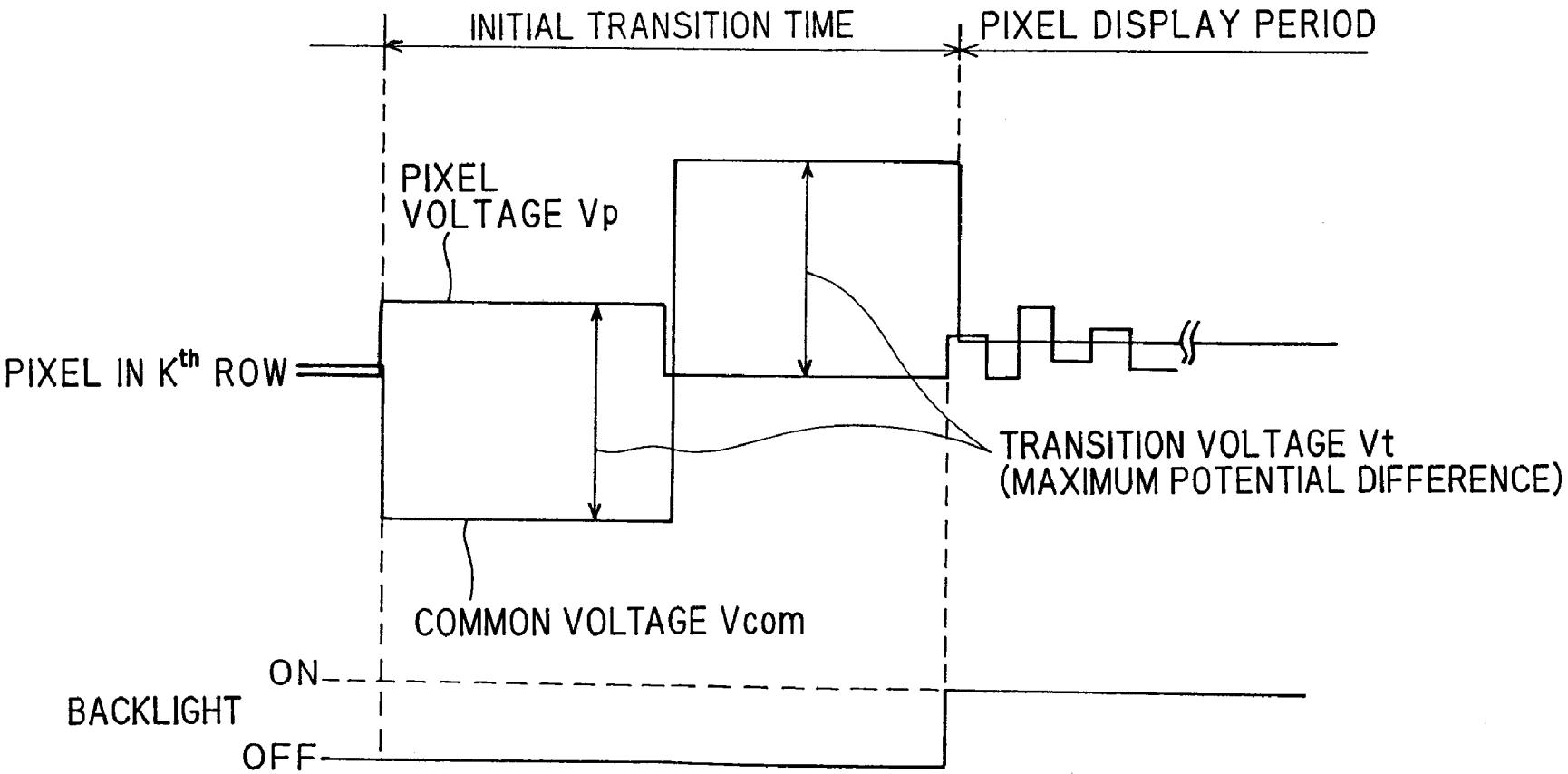
FIG. 5 is a waveform chart showing a method of applying a transition voltage Vt according to the first embodiment.

Referring now to FIG. 5, an operation of the liquid crystal display apparatus 10 according to the first embodiment will be described. FIG. 5 is a waveform chart showing variations of the common voltage Vcom and the pixel voltage Vp in a display pixel on a $k^{th}$ row and $i^{th}$ column.

(4-1) Operation of Image Display Time

Referring now to FIG. 5, an operation during an image display time after having elapsed a predetermined initial transition time will be described.

The operation of the image display time is as follows. The common voltage Vcom is maintained at a constant value lying substantially midway between the positive common voltage Vcom-p and the negative common voltage Vcom-n on the basis of the control from the controller 30 and the signal line driver circuit 26 applies the pixel voltage Vp which is inverted in polarity with respect to the reference pixel voltage Vp-c so that the polarity of the pixel voltage Vp applied to an OCB liquid crystal 18 is inverted every frame between adjacent frames (1/60 seconds) on the basis of a polarity inverting signals from the controller 30, thereby displaying an image through a frame inversion drive. As shown in FIG. 5, a backlight 90 is kept in ON state, that is, in an illuminated state during the image display period.

(4-2) Operation during Initial Transition Time

Subsequently, an operation during the initial transition time prior to the image display period will be described on the basis of FIG. 5.

The initial transition time corresponds to two second (2 sec.) from the power is turned ON. In the first embodiment, a transition voltage Vt is applied in the initial transition time as shown in FIG. 4.

The common voltage Vcom is inverted in polarity with respect to the common voltage Vcom-c at every certain period (0.5 seconds, for example) on the basis of the control from the controller 30.

The pixel voltage Vp is inverted in polarity at the same timing as the timing of the frame inversion (the timing of inversion of the common voltage Vcom) so that the polarity thereof becomes opposite from the polarity of the common voltage Vcom on the basis of a polarity inverting signal POL from the controller 30. The pixel voltage Vp is set to a voltage at which the transition voltage Vt becomes the maximum value on the basis of the dummy digital video signal Data from the controller 30, for example, a voltage which corresponds to the black display.

In this configuration, the potential difference between the pixel electrode 29 and a common electrode 48 is always the maximum during the initial transition time, and hence a sufficient transition voltage Vt is ensured and the initial transition time is reduced. Therefore, a sufficient transition voltage Vt is ensured and the initial transition time is reduced without providing a specific booster circuit as in the related art.

For example, a negative common voltage Vcom-n of −20V and a positive common voltage Vcom-p of 30V are applied alternately as the common voltage Vcom to a reference common voltage Vcom-c (5V, for example) on the basis of the polarity inverting signal POL from the controller 30. A voltage of 10V which is the maximum voltage within a positive pixel voltage range (5 to 10V, for example) with respect to the reference pixel voltage Vp-c (5V, for example) is applied to the pixel electrode 29 and a voltage of 0V which is the minimum voltage within a negative pixel voltage range (0 to 5V, for example) is applied with respect to the reference pixel voltage Vp-c (5V, for example) is applied to the pixel electrode 29 alternately as the common voltage Vp on the basis of the polarity inverting signal POL from the controller 30 and the dummy digital video signal Data. Therefore, a transition voltage Vt of 30V, which is larger than the amplitude on the side of one polarity of the common voltage Vcom (the potential difference between the Vcom-p and Vcom-c, or 25V which is the potential difference between Vcom-n and Vcom-c) is applied to the OCB liquid crystal 18 irrespective of the polarity inversion of the common voltage Vcom.

Then, as shown in FIG. 5, the backlight 90 is turned OFF, that is, extinguished during the initial transition time. Accordingly, the image during the initial transition time is displayed in a halftone grayscale, which is not actually recognized.

In the configuration described above, quick and reliable phase transition in comparison with the related art is achieved.

(5) Configuration of Signal Line Drive Circuit 26

Figure 13:
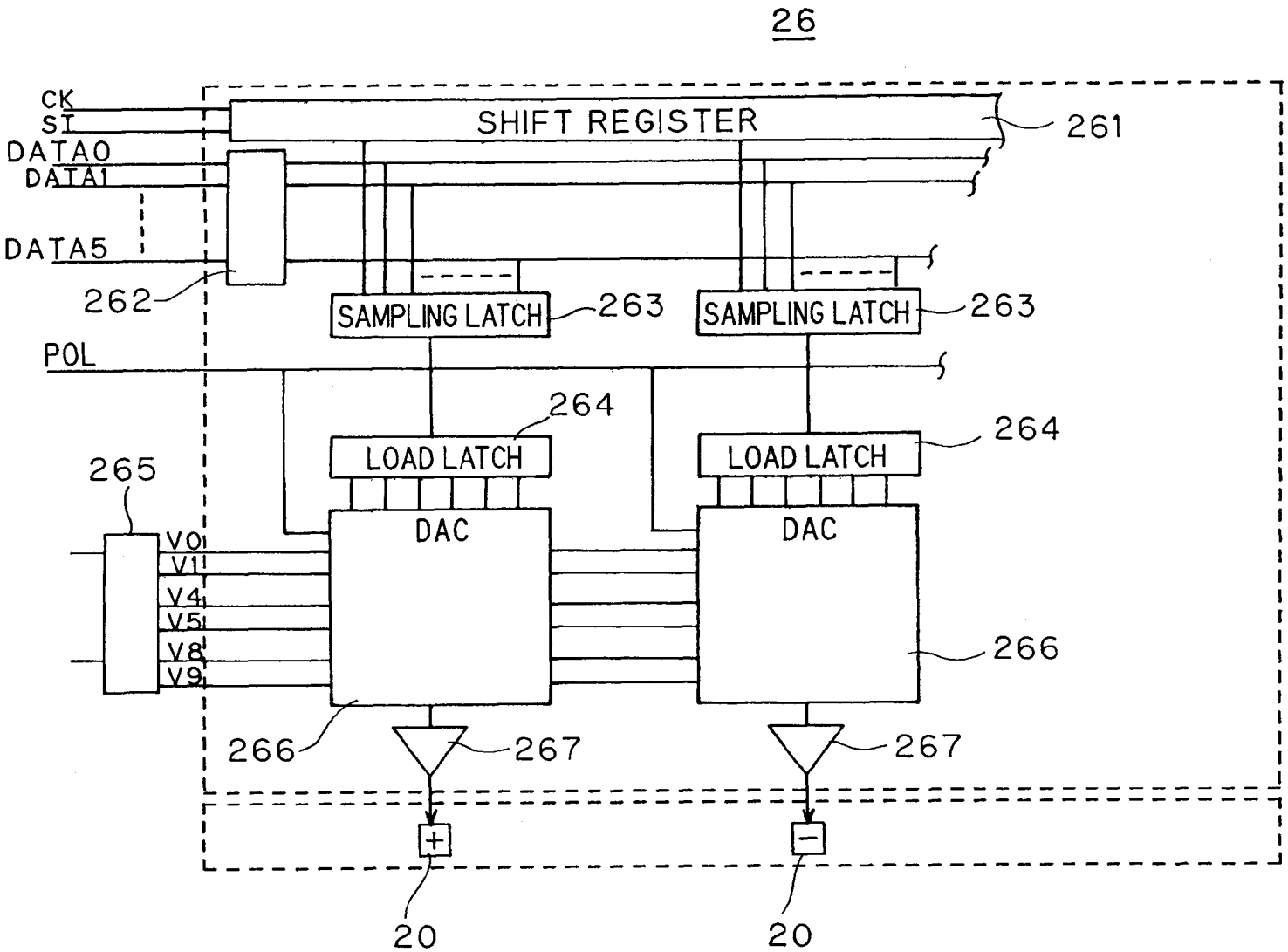
FIG. 13 is a block diagram of a signal line driver circuit according to the first embodiment.

Referring now to FIG. 13, the configuration of the signal line driver circuit 26 in the first embodiment will be described.

The signal line driver circuit 26 includes a shift register 261, an input circuit 262, a plurality of sampling latch circuits 263, a plurality of load latch circuits 264, a plurality of DACs (Digital Analogue Converters) 266, a plurality of amplifiers 267 connected as shown in FIG. 13, there exists the same numbers of sampling latch circuits 263, load latch circuits 264, the DACs 266, and the amplifiers 267 as the number of the corresponding signal lines 20.

The controller 30 enters the horizontal clock signals CKH and the start signals STH to the shift register 261, and the shift register 261 outputs register signals in sequence to the respective sampling latch circuits 263.

The digital video signals Data are configured by, in the case of the first embodiment, 6-bit deta (Data 0 to 5), and the digital vide signals are entered to the input circuit 262 to be aligned in timing, and are entered to the respective sampling latch circuits 263.

The sampling latch circuits 263 output the entered digital video signals Data to the load latch circuits 264 on the basis of the register signals.

The load latch circuits 264 output the entered respective digital video signals Data to the DACs 266.

Ten gradation voltages V0 to V9 between 0 to 10V and polarity inverting signal POL from the controller 30 are entered from a reference voltage generating circuit 265 provided outside. The DACs 266 are converted into analogue video signals having the gradation voltages corresponding to the digital video signals Data and outputted. At this time, the DACs 266 is controlled so that the analogue video signals are inverted in polarity with respect to the reference pixel voltage Vp-c on a frame to frame basis on the basis of the polarity inverting signal POL.

Finally, the outputted analogue video signals are amplified in the amplifiers 267 and outputted to the signal lines 20.

In this configuration, one of the positive pixel voltage range from 5 to 10V and the negative pixel voltage range from 0 to 5V is selected for the signal line driver circuit 26 on the basis of the polarity inverting signal POL supplied from the controller 30, and one of the voltages corresponding to the positive pixel voltage range and the negative pixel voltage range is selected and outputted on the basis of the entered digital video signal Data or the dummy digital video signal Data.

Here, in the case of the first embodiment, the frame inversion drive is carried out on a frame to frame basis during the image display period, and the frame inversion drive is carried out also during the initial transition time. Therefore, the analog video signals are controlled to be inverted in polarity on a frame to frame basis on the basis of the polarity inverting signal POL from the controller 30, so that the voltage outputted to the signal lines 20 is inverted in polarity.

In the initial transition time, the dummy digital video signal Data to which the pixel voltage Vp described above is applied may be entered to the input circuit 262 from the controller 30. In the image display period, the digital video signal Data may be entered in the same manner as in the related art.

Accordingly, the operation during the image display period and the operation during the initial transition described above are realized.

(6) Modification (6-1) Modification 1

Figure 11:
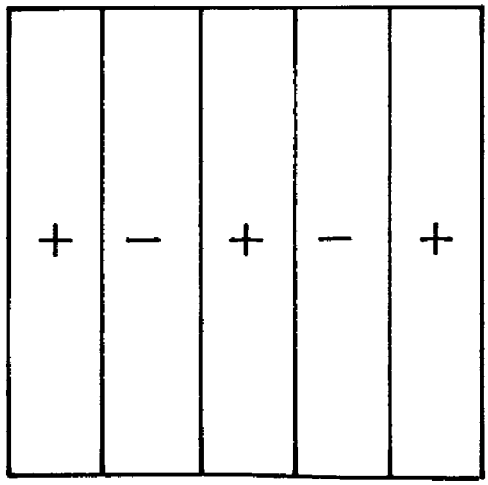
FIG. 11 is an explanatory drawing showing the state of inversion of the polarity on a column to column basis.

In the first embodiment, the frame inversion drive is carried out during the initial transition time, and the frame inversion drive is carried out during the image display period. However, the invention is not limited thereto, and a configuration in which the frame inversion drive is carried out during the initial transition time and a column inversion drive shown in FIG. 11 is carried out for displaying the image during the image display period is also applicable.

Figure 14:
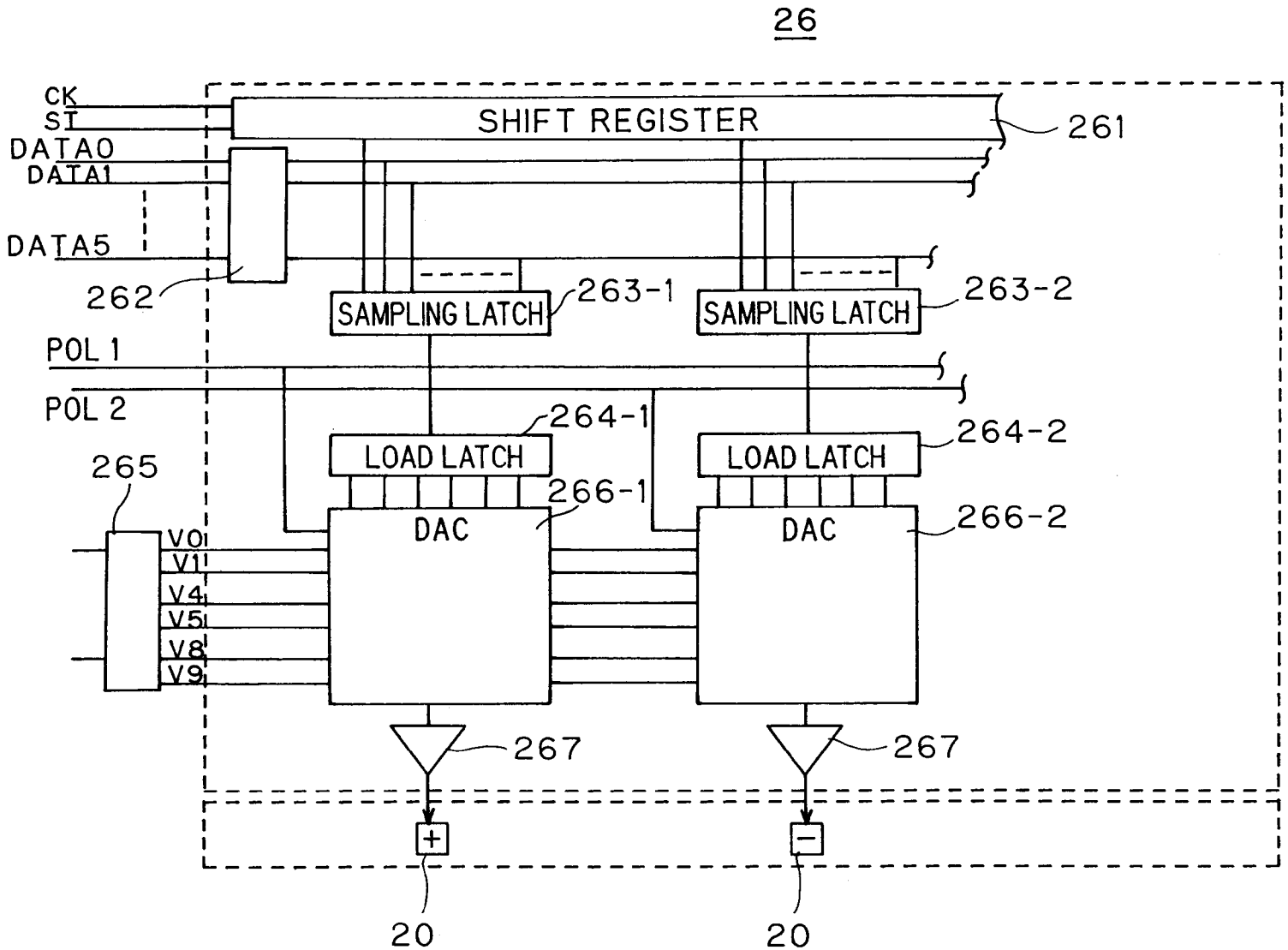
FIG. 14 is a block diagram of a signal line driver circuit according to a modification of the first embodiment.

A configuration of the signal line driver circuit 26 in this case will be described on the basis of FIG. 14.

In the first embodiment shown above, since it is necessary to carry out the column inversion drive during the image display period, two type of polarity inverting signals are entered from the controller 30. In other words, since the polarity inversion is carried out on a row to row basis, for example, a first polarity inverting signal POLL is entered to the first DACs 266-1 in odd positions and a second polarity inverting signal POL2 is entered to the second DACs 266-2 in even positions.

When the frame inversion drive is carried out during the initial transition time, the polarities of the first polarity inverting signal and the second polarity inverting signal are matched and the polarity is inverted on a frame to frame basis.

In contrast, when the column inversion drive is carried out during the image display period, the polarities of the first polarity inverting signal and the second polarity inverting signal are inverted to carry out the column inversion drive.

(6-2) Modification 2

In the first embodiment, during the initial transition, the pixel voltage Vp is set to 0V which is the minimum value within the negative pixel voltage range (0 to 5V, for example) when the positive common voltage Vcom-p is applied to the common electrode, and the pixel voltage Vp is set to 10V which is the maximum value in the positive pixel voltage range (5 to 10V, for example) when the negative common voltage Vcom-n is applied to the common electrode, so that a transition voltage Vt of 30V which is constantly larger than the amplitude on the side of one polarity of the common voltage Vcom (the potential difference between the Vcom-p and Vcom-c, or 25V which is the potential difference between Vcom-n and Vcom-c) is applied to the OCB liquid crystal 18 irrespective of the polarity inversion of the common voltage Vcom.

However, a configuration in which the pixel voltage Vp is set to a voltage which is smaller than 5V which is the maximum value in the negative pixel voltage range (0 to 5V, for example), more preferably, to 2.5V, which is equal to or smaller than half the negative pixel voltage range when the positive common voltage Vcom-p is applied to the common electrode, and the pixel voltage Vp is set to a voltage larger than 5V which is the minimum value in the positive pixel voltage range (5 to 10V, for example), more preferably, to 7.5V, which is equal to or larger than half the positive pixel voltage range when the negative common voltage Vcom-n is applied to the common electrode is also applicable.

Accordingly, although the initial transition time is increased in comparison with the embodiment, a transition voltage Vt which is constantly larger than the amplitude on the side of one polarity of the common voltage Vcom (the potential difference between the Vcom-p and Vcom-c, or 25V which is the potential difference between Vcom-n and Vcom-c) is applied to the OCB liquid crystal 18 irrespective of the polarity inversion of the common voltage Vcom.

(6-3) Modification 3

In the first embodiment, the initial transition time is fixed to a time during which the initial transition is ensured even at a low temperature which hardly allow the initial transition, for example, to two second (2 sec.). However, the initial transition time may be varied on the basis of the panel temperature detected by a temperature sensor.

(6-4) Modification 4

In the first embodiment, the controller 30 stores one type of the dummy digital video signal Data. However, the controller 30 may be configured to select one type of a plurality of the dummy digital video signals Data stored therein according to the panel temperature detected by the temperature sensor or the like.

For example, since the transition is hardly occurred in the OCB liquid crystal at a low temperature, a dummy digital video signal Data may be selected so that the maximum voltage is applied as the transition voltage Vt. In contrast, since the transition is easily occurred in the OCB liquid crystal at a high temperature, a dummy digital video signal Data may be selected so that a voltage other than the maximum voltage is applied as the transition voltage Vt.

Second Embodiment

Referring now to FIG. 6 to FIG. 10, the liquid crystal display apparatus 10 of the OCB mode according to a second embodiment will be described.

The second embodiment is different from the first embodiment in the configuration of the transition nucleus, and drive thereof during the image display period and the initial transition time.

(1) Configuration of Transition Nucleus 32

A configuration of the transition nucleus 32 according to the second embodiment will be described on the basis of FIG. 6 and FIG. 7. In the description shown below, a pixel electrode 29A, which is one of the pixel electrodes 29 and a pixel electrode 29B which is adjacent to the pixel electrode 29A in the vertical direction are described for the sake of convenience. In other words, the adjacent pixel electrodes 29A and 29B provided corresponding to the adjacent gate lines 22 are used for description.

Figure 6:
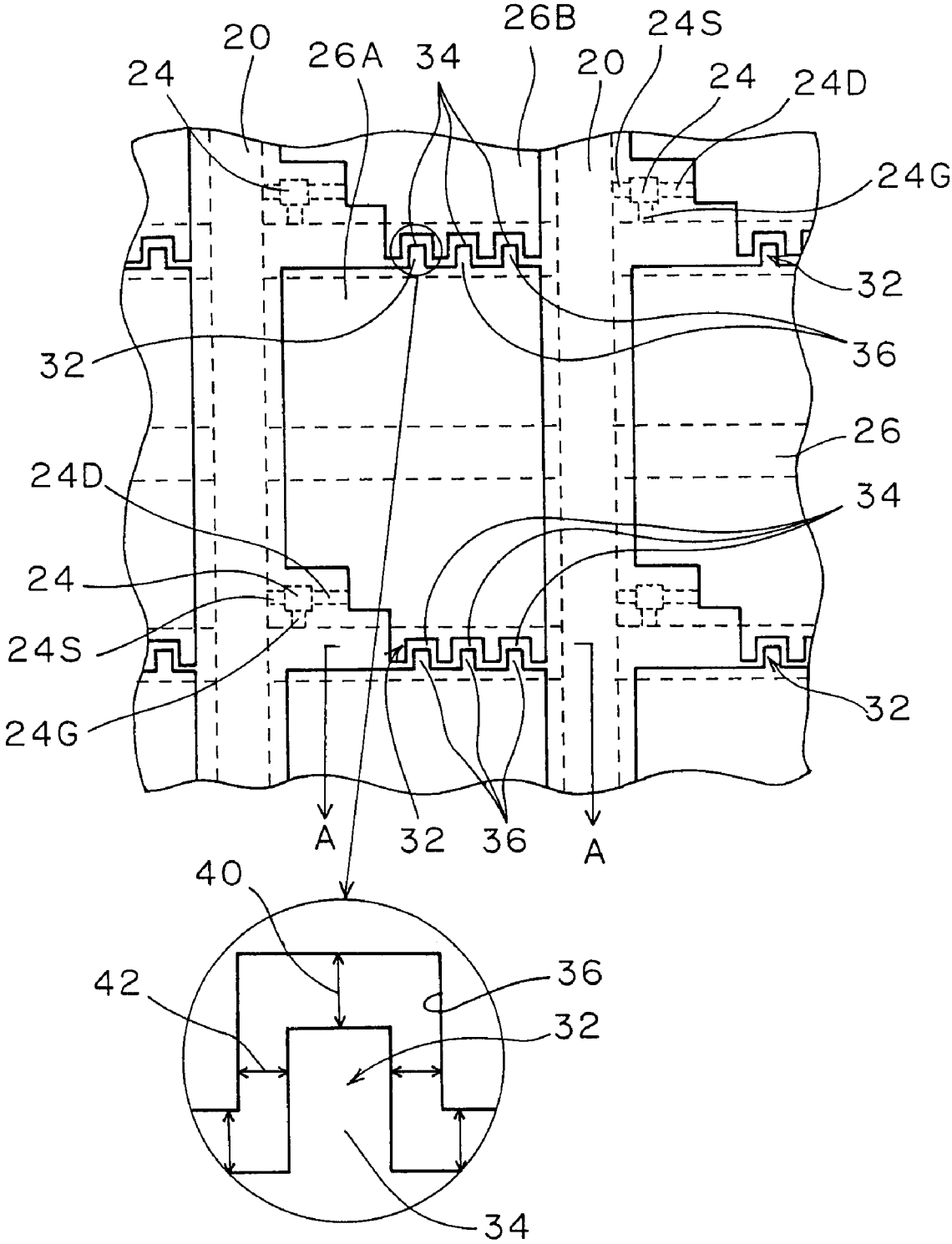
FIG. 6 is a plan view of the array substrate of the liquid crystal display apparatus according to a second embodiment.

As shown in FIG. 6, the pixel electrode 29A is arranged so as to be overlapped at one end thereof with the gate line 22, and the one end is formed with a plurality of projections 34 projecting in the direction of the length of the signal line 20. The end of the pixel electrode 29B opposing the end where the projections 34 are provided projects toward the gate line 22 so as to be overlapped with the gate line 22. The projected portions are formed with recesses 36 corresponding to the plurality of projections 34 in the areas overlapped with the gate line 22. The pixel electrode 29 and the gate line 22 are overlapped with each other via an insulating layer 38 as shown in FIG. 3.

In the liquid crystal display apparatus 10 configured as described above, when the transition voltage which causes the initial splay-to-bend transition is applied, the potential difference of the OCB liquid crystal 18 in the direction of thickness is increased. Therefore, since the projections 34 and the recesses 36 corresponding to the projections 34 are provided so as to be overlapped with the gate line 22, a concentrated electric field (fringe electric field) in the direction oblique to the direction of thickness of the OCB liquid crystal 18 is generated in the periphery between the projections 34 and the recesses 36 corresponding to the projections 34. Therefore, the molecules of the OCB liquid crystal arranged in the periphery between the projections 34 and the recesses 36 serve as the transition nucleus and hence the splay-to-bend transition is ensured. Such a fringe electric field may be configured between the pixel electrode and an auxiliary capacity line overlapped thereon, in addition to the configuration shown above.

Figure 7:
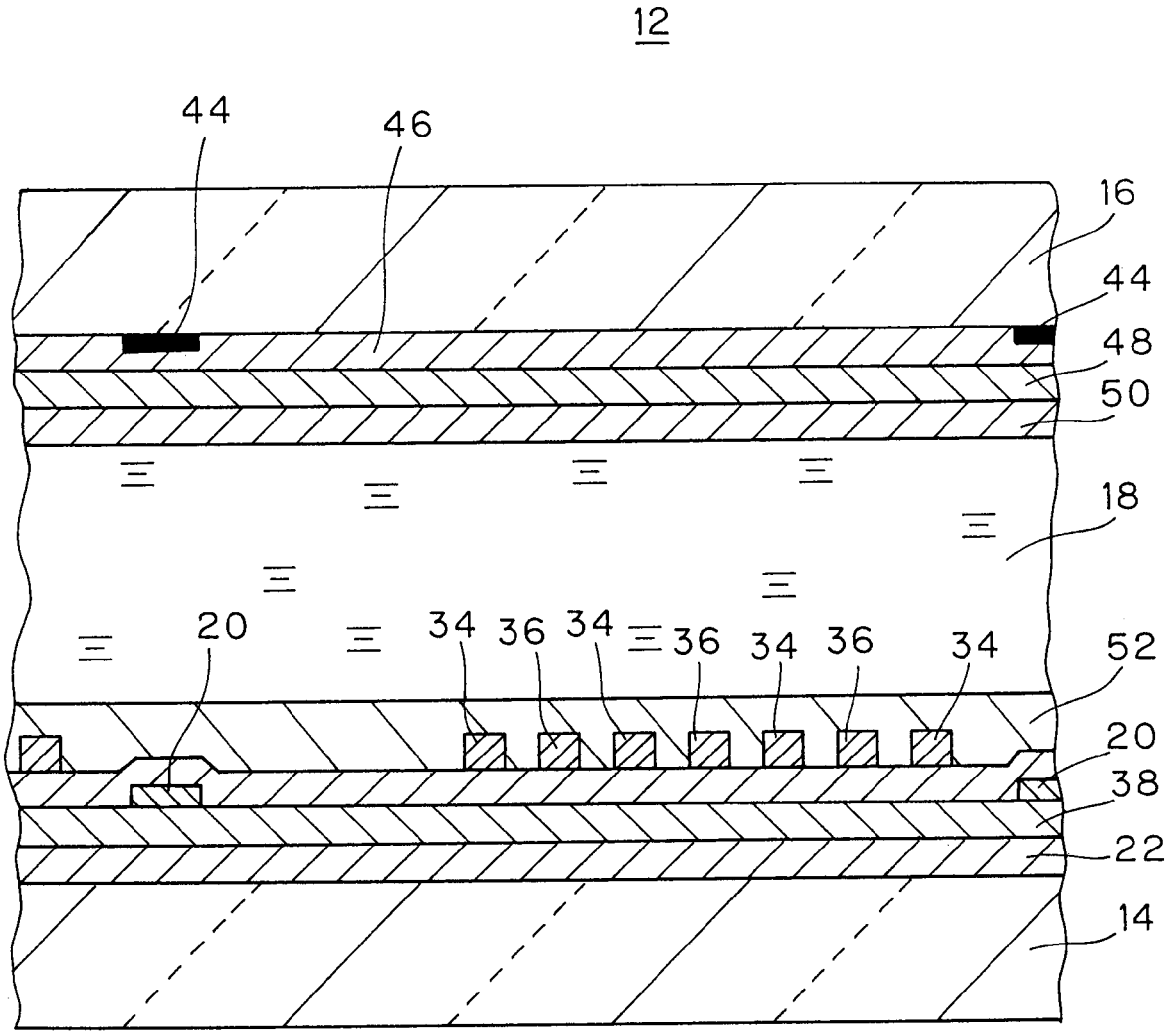
FIG. 7 is a cross-sectional view taken along the line A-A in FIG. 6.

As shown in FIG. 7, the common substrate 16 is provided with a RGB color filter 46 via the black matrix 44, and, a common electrode 48 and an alignment lay 50 are laminated on the upper surface thereof. The common electrode 48 of the common substrate 16 receives supply of the common voltage Vcom from the controller 30. An alignment lay 52 is laminated also on the upper surface of the pixel electrode 29.

In the second embodiment, when the polarities of the voltage to be applied to the adjacent two pixel electrodes 29A, 29B respectively are inverted as described later, as shown by arrows 40 and 42 in the enlarge view in FIG. 6, a lateral electric field in two directions in plan view is generated between the two adjacent pixel electrodes 29A and 29B. In this configuration, the resilient distortion energy of the OCB liquid crystal molecules is increased between the two adjacent pixel electrodes 29A and 29B and consequently, the negative energy is increased. Therefore, the initial transition is carried out further smoothly.

The distance between the projections 34 and the recesses 36 is preferably from 4 μm to 8 μm inclusive.

(2) Operation of Liquid Crystal Display Apparatus 10

Figure 8:
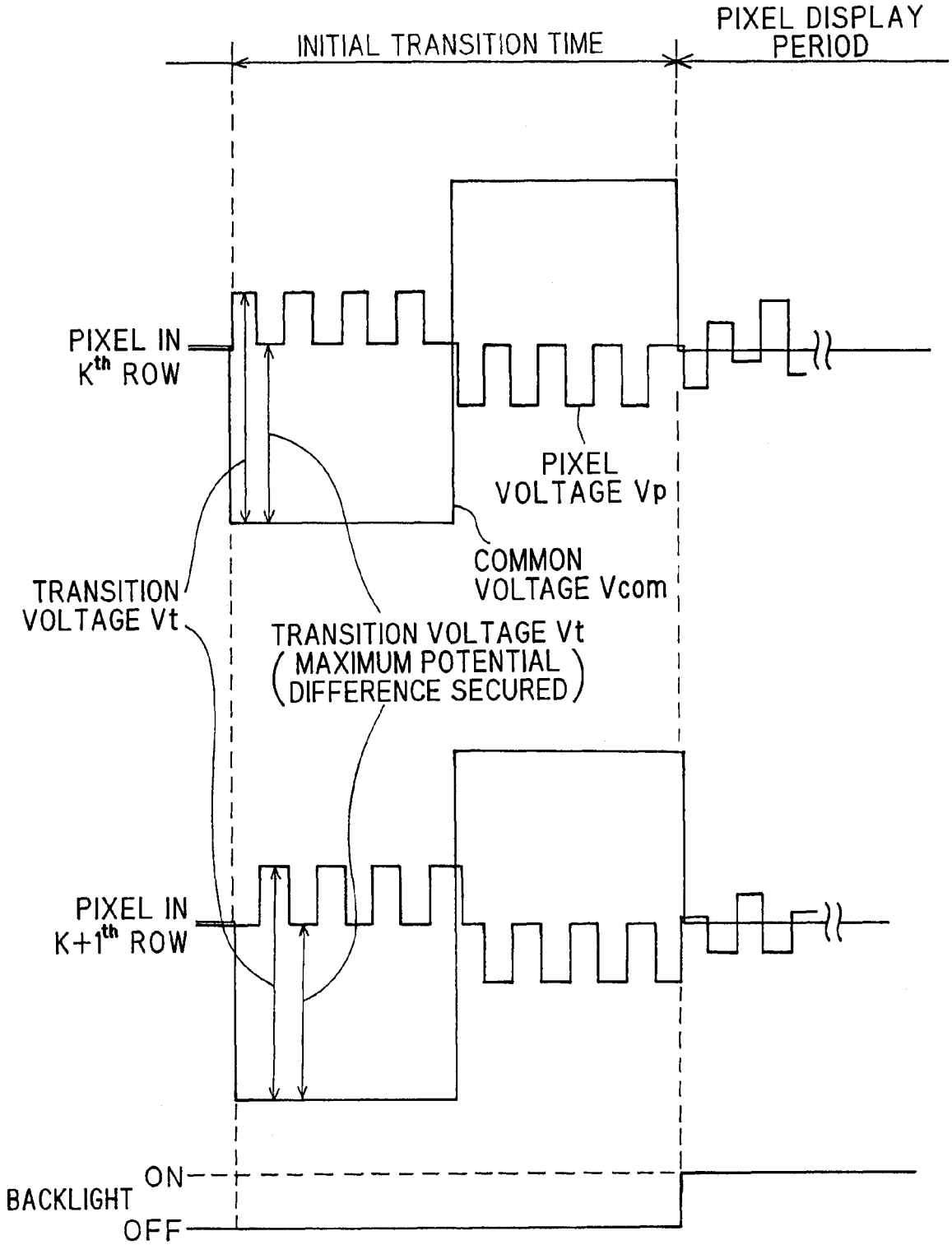
FIG. 8 is a waveform chart showing a method of applying the transition voltage Vt according to the second embodiment.

Referring to FIG. 8, the liquid crystal display apparatus 10 according to the second embodiment will be described. FIG. 8 is a waveform chart showing variations in common voltage and pixel voltage of a display pixel at $k^{th}$ row, $i^{th}$ column and a display pixel at $(k+1)^{th}$ row, $i^{th}$ column and the state of the backlight.

(2-1) Operation of Image Display Period

The operation during the image display period after having elapsed a predetermined initial transition time will be described on the basis of FIG. 8.

The operation during the image display period is as follows. The common voltage Vcom is maintained at a constant value lying substantially midway between the positive common voltage Vcom-p and the negative common voltage Vcom-n on the basis of the control from the controller 30 and the signal line driver circuit 26 applies the pixel voltage Vp which is inverted in polarity with respect to the common voltage Vcom so that the polarity of the pixel voltage Vp applied to an OCB liquid crystal 18 is inverted every frame between adjacent frames (1/60 seconds) on the basis of a polarity inverting signals POL from the controller 30, and a dot inversion drive is combined for applying the pixel voltage Vp which is inverted in polarity with respect to the common voltage Vcom so that the polarity of the voltage to be applied to the OCB liquid crystal 18 between the adjacent pixels is inverted for further reduction of an occurrence of flicker, thereby displaying the image.

Then, as shown in FIG. 8, the backlight 90 is kept in the ON state, that is, in an illuminated state during the image display period.

(2-2) Operation in Initial Transition Time

The operation during the initial transition time prior to the image display period will be described on the basis of FIG. 8.

According to the second embodiment, the common voltage Vcom is inverted in polarity with respect to the reference common voltage Vcom-c at every 0.5 second under the control of the controller 30 as in the first embodiment.

Figure 10:
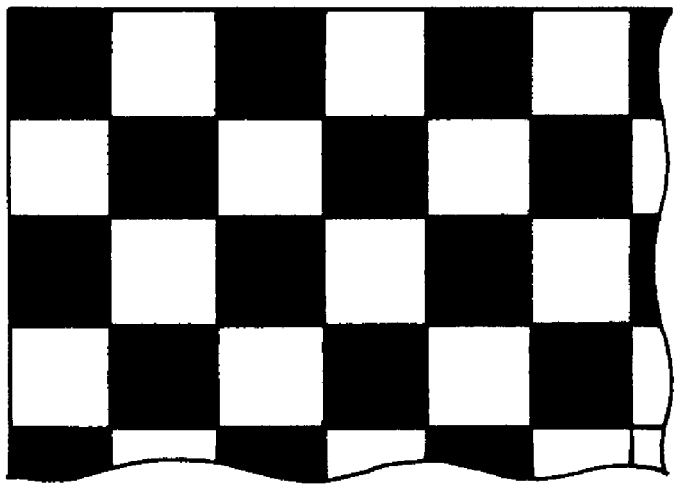
FIG. 10 is an explanatory drawing showing a state of a dummy digital video signal Data during an initial transition time.

The pixel voltage Vp is different from the first embodiment described above, and varies from pixel to pixel (every horizontal scanning period) also in the frame. More specifically, dummy digital video signals Data which correspond to the black display as shown in FIG. 10 and dummy digital video signals Data which correspond to the white display are outputted alternately and the polarity inverting signal POL is also outputted from the controller 30.

Accordingly, for a frame in which the common voltage Vcom is a negative common voltage Vcom-n of −20V with respect to the reference common voltage Vcom-c (5V, for example), the signal line driver circuit 26 outputs a voltage of 10V which is the maximum voltage within the positive pixel voltage range (5 to 10V, for example) with respect to the reference pixel voltage Vp-c (5V, for example) to a pixel electrode 29 and a voltage of 5V which is the maximum voltage within the negative pixel voltage range (0 to 5V, for example) to an adjacent pixel electrode 29 respectively on the basis of the polarity inverting signal POL and the dummy digital video signal Data from the controller 30. Consequently, when the common voltage Vcom is a negative common voltage Vcom-n of −20V, for example, a transition voltage Vt of 30V is applied to the one display pixel and a transition voltage Vt of 25V is applied to the adjacent display pixel, respectively.

In contrast, for a frame in which the common voltage Vcom is a positive common voltage Vcom-p of 30V with respect to the reference common voltage Vcom-c (5V, for example), a voltage of 0V which is the minimum voltage within the negative pixel voltage range (0 to 5V, for example) with respect to the pixel reference voltage Vp-c (5V, for example) is outputted to a pixel electrode 29, and a voltage of 5V which is the minimum voltage within the positive pixel voltage range (5 to 10V, for example) with respect to the pixel reference voltage Vp-c (5V, for example) is outputted to an adjacent pixel electrode 29 respectively on the basis of the polarity inverting signal POL and the dummy digital video signal Data from the controller 30. Consequently, even when the common voltage Vcom is a positive common voltage Vcom-p of 30V, a transition voltage Vt of 30V is applied to the one display pixel and a transition voltage Vt of 25V is applied to the adjacent display pixel, respectively.

As shown in FIG. 8, the backlight 90 is kept in OFF state, that is, in an extinguished state during the initial transition time. Accordingly, the change of the image during the initial transition time is not recognized.

Figure 9:
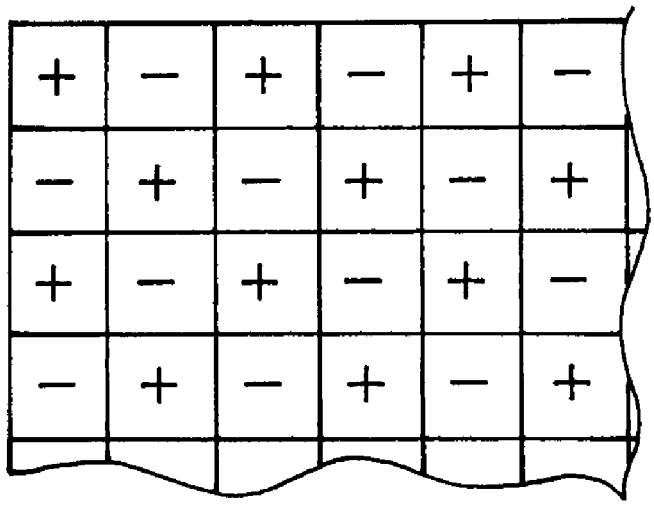
FIG. 9 is an explanatory drawing showing a state of inversion of the polarity on a dot to dot basis.

In other words, according to the second embodiment, during the initial transition time, the pixel voltage Vp which maximizes the transfer voltage Vt to be applied to the OCB liquid crystal 18 is selectively applied while maintaining dot inversion in which the polarity with respect to the reference pixel voltage Vp-c is inverted on a pixel to pixel basis as show in FIG. 9. In other words, the dummy digital video signal Data has a voltage which displays black pixels of positive polarity and white pixels of negative polarity alternately in the vertical direction and the lateral direction as shown in FIG. 10, and the black pixels and the white pixels are inverted on a frame to frame basis. However, since the common voltage Vcom is a voltage having a sufficiently large potential difference with respect to the pixel voltage Vp during the initial transition, a checkered pattern in a halftone grayscale is actually displayed instead of a checkered pattern in black and white. However, since the backlight 90 is extinguished as described above during this initial transition time, the undesired image is not recognized.

Since the two-direction lateral electric field is also applied to the OCB liquid crystal 18 between the adjacent pixel electrodes by the dot inversion drive, the nucleus are easily formed.

Therefore, assuming that the panel temperature is −30° C., a reliable phase transition is achieved in two second (2 sec.), while it takes 6 seconds for the initial transition in the related art.

(3) Configuration of Signal Line Driver Circuit 26

Figure 15:
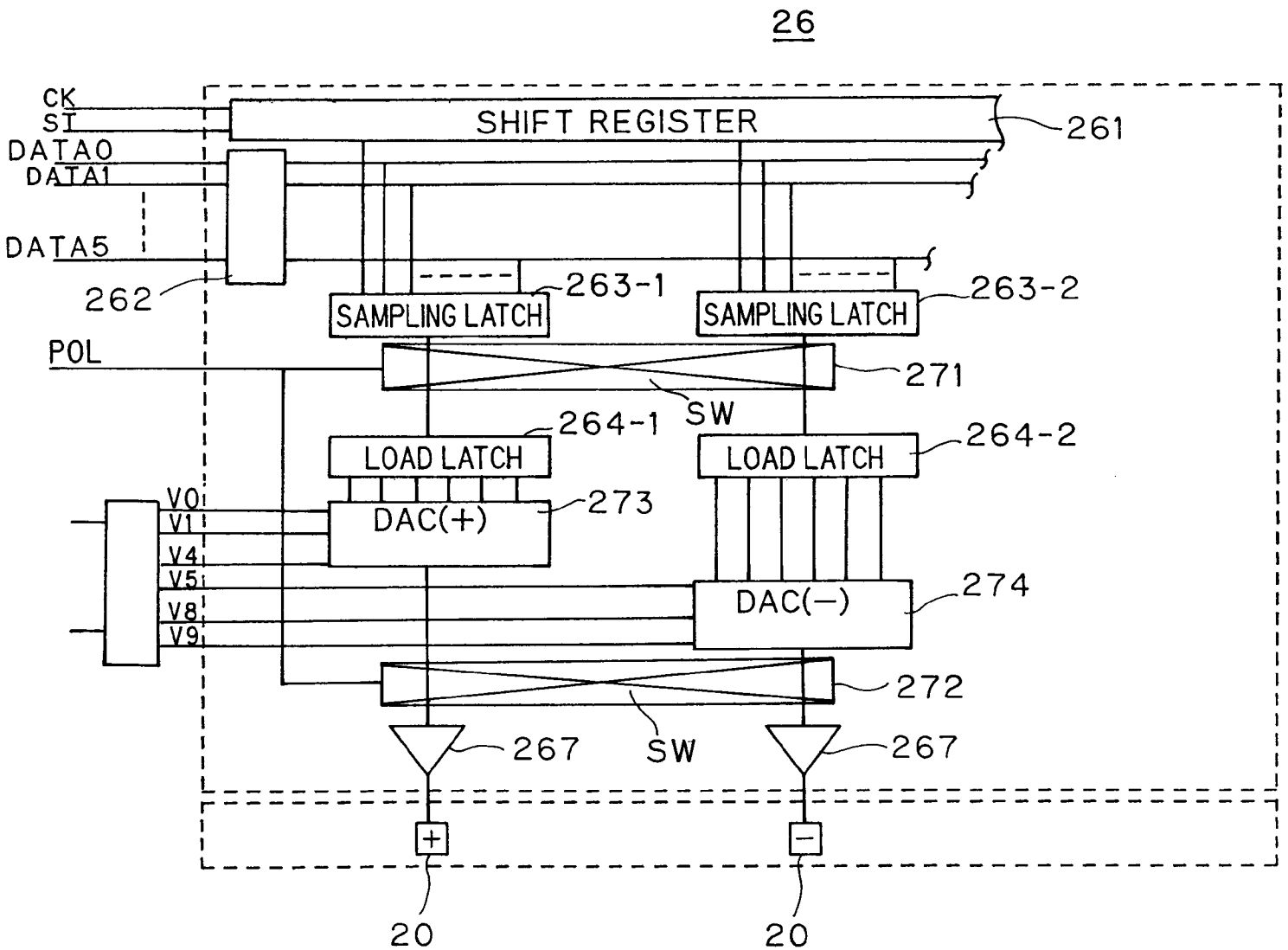
FIG. 15 is a block diagram of the signal line driver circuit according to the second embodiment.
Figure 16:
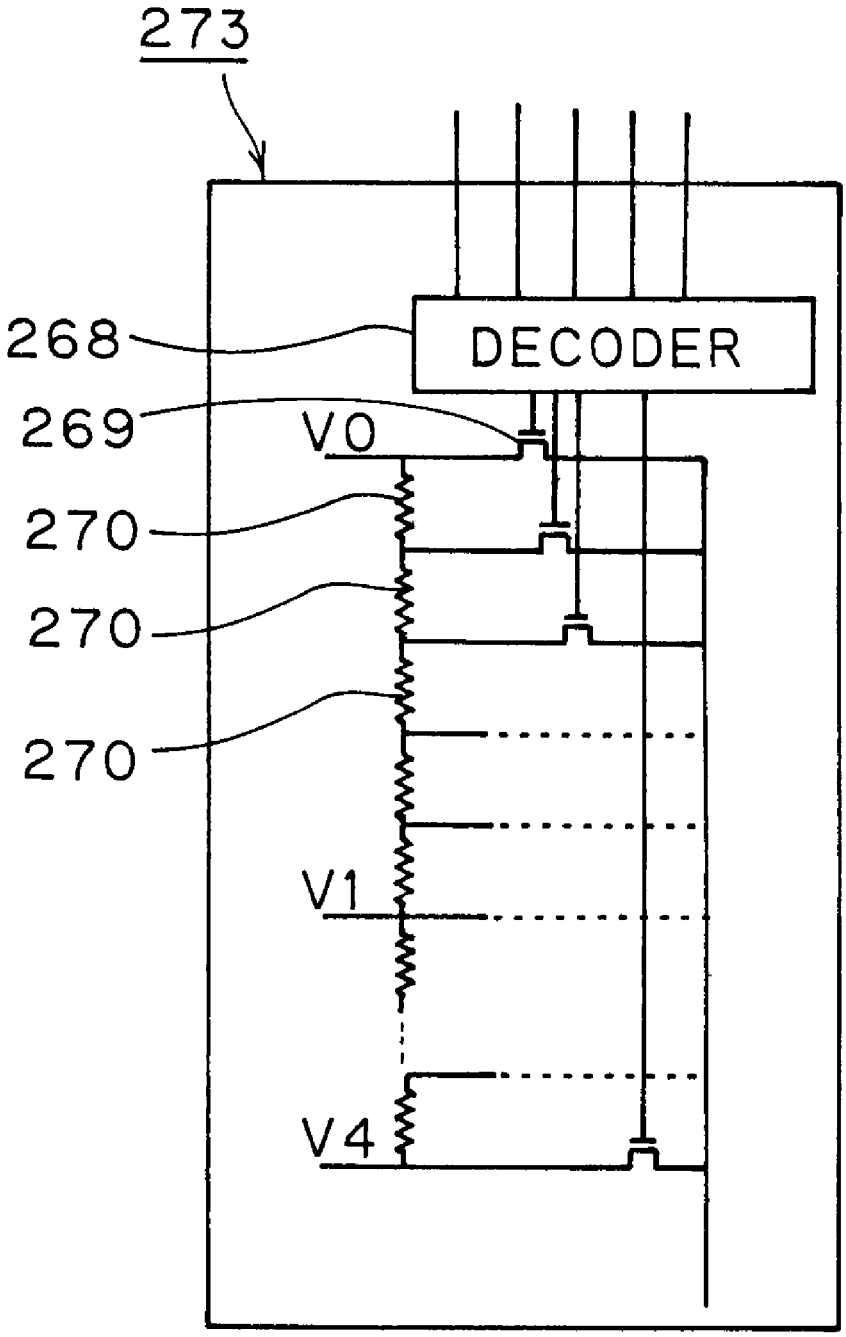
FIG. 16 is a block diagram of a first DAC of the signal line driver circuit according to the second embodiment.
Figure 17:
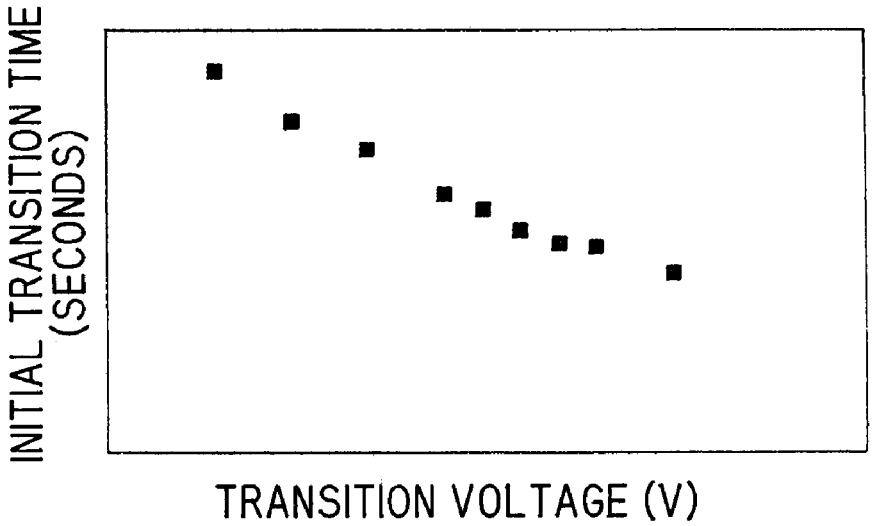
FIG. 17 is a graph showing a relation between the transition voltage Vt and the initial transition time.
Figure 18:
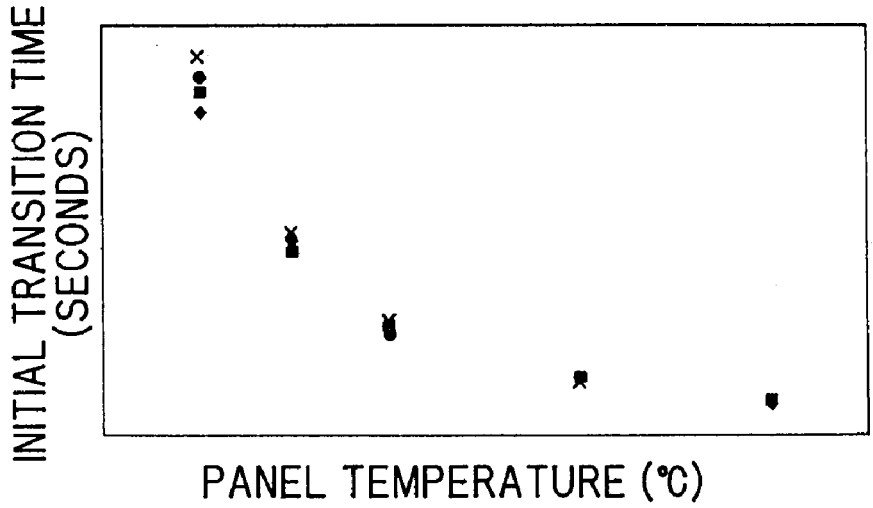
FIG. 18 is a graph showing a relation between a panel temperature and the initial transition time.
Figure 19:
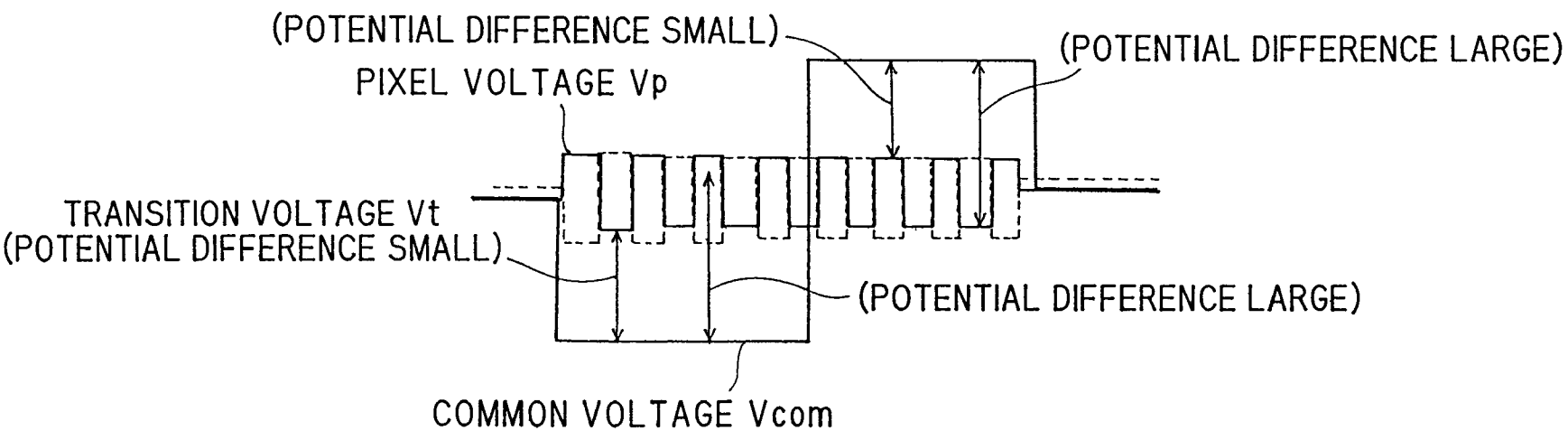
FIG. 19 is a waveform chart showing a method of application of the transition voltage Vt in a method of dot inversion drive in the related art.

Referring now to FIG. 15 and FIG. 16, a configuration of the signal line driver circuit 26 in the second embodiment will be described.

In the second embodiment, it is necessary to carry out the dot inversion drive shown in FIG. 9 in the image display period and the initial transition time. Therefore, it is necessary to invert the polarity with respect to the reference pixel voltage Vp-c between the adjacent signal lines 20. In view of such circumstances, different points from the signal line driver circuit 26 in the first embodiment will be described.

As described above, since it is necessary to invert the polarity with respect to the reference pixel voltage Vp-c between the adjacent signal lines 20, a first polarity inverting switch 271 is inserted between the adjacent sampling latch circuits 263. The first polarity inverting switch 271 is adapted to send a signal sent from a first sampling latch circuit 263-1 by the polarity inverting signal POL outputted from the controller to either a first load latch circuit 264-1 or a second load latch circuit 264-2. On the other hand, a second sampling latch circuit 263-2 is also controlled by the first polarity inverting switch 271 to send the signal to the first load latch circuit 264-1 or to the second load latch circuit 264-2.

The digital video signal Data outputted from the first load latch circuit 264-1 is sent to a first DAC 273.

The first DAC 273 is a circuit specific for the positive polarity with respect to the reference pixel voltage Vp-c, and the detailed structure is shown in FIG. 15. In other words, the digital video signal Data sent from the first load latch circuit 264-1 is input to a decoder 268. On the other hand, the gradation voltages V0 to V4 from among the ten gradation voltages V0 to V9 between 0 to 10V are entered from the reference voltage generating circuit provided on outside to the resistant circuit having a plurality of resistance elements 270 connected in series and divided into partial pressures, thereby being outputted, for example, as 256 types of partial pressure voltages. Then, the partial pressure voltages are entered into the switching element 269. When the switching element 269 is turned ON and OFF on the basis of control signals outputted from the decoder 268, analogue video signals (partial pressure voltages) corresponding to the digital video signals DATA are outputted.

The analogue video signals outputted from the first DAC 273 are sent to a second polarity inverting switch 272.

On the other hand, the digital video signal Data outputted from the second load latch circuit 264-2 is sent to a second DAC 274. The second DAC 274 is a circuit specific for the negative polarity with respect to the reference pixel voltage Vp-c. The second DAC 274 has the same structure as the first DAC 273, and divides the voltages V5 to V9 from among the gradation voltages V0 to V9 by the resistance circuit having a plurality of resistance elements connected in series and outputs the same as 256 types of partial pressure voltages. The analogue video signal outputted from the second DAC 274 is also sent to the second polarity inverting switch 272.

The second polarity inverting switch 272 outputs the signals either to the signal line 20 on the positive polarity or to the signal line 20 on the negative polarity on the basis of the polarity inverting signal POL. The output is carried out in correspondence with the first polarity inverting switch 271.

In this configuration, the image is displayed while inverting the polarities of the adjacent pixels and, in addition, the configurations of the respective DAC 273 and 274 are simplified.

In the initial transition time, as described above, the pixel voltage Vp is inverted to voltages corresponding to black on the side of the positive polarity and to white on the side of the negative polarity with respect to the reference pixel voltage Vp-c alternately and these voltages are inverted on a frame to frame basis when displaying the image. In the image display period, the normal image display is carried out through the dot inversion drive.

(4) Modification (4-1) Modification 1

In the second embodiment, when the positive common voltage Vcom-p (30V, for example) is applied to the common electrode during the initial transition time, the pixel voltage Vp of the negative pixel electrode is set to 0V which is the minimum voltage in the negative pixel voltage range (0 to 5V, for example), and the pixel voltage Vp of the positive pixel electrode is set to 5V which is the minimum voltage in the positive pixel voltage range (5 to 10V, for example), so that a transition voltage Vt of at least 25V which is at least the same as the amplitude on the side of one polarity of the common voltage Vcom (the potential difference between the Vcom-p and Vcom-c, or 25V which is the potential difference between Vcom-n and Vcom-c) is applied to the OCB liquid crystal 18 irrespective of the polarity inversion of the common voltage Vcom.

However, a configuration in which the pixel voltage Vp of the negative pixel electrode is set to a voltage which is smaller than 5V which is the maximum value in the negative pixel voltage range (0 to 5V, for example), more preferably, to 2.5V, which is equal to or smaller than half the negative pixel voltage range and the pixel voltage Vp of the positive pixel electrode is set to a voltage smaller than 10V which is the maximum value in the positive pixel voltage range (5 to 10V, for example), more preferably, to 7.5V, which is equal to or smaller than half the positive pixel voltage range when the positive common voltage Vcom-p (30V, for example) is applied to the common electrode is also applicable. Alternatively, a configuration in which the pixel voltage Vp of the negative pixel electrode is set to a voltage which is larger than 0V which is the minimum value in the negative pixel voltage range (0 to 5V, for example), more preferably, to 2.5 V, which is equal to or larger than half the negative pixel voltage range and the pixel voltage Vp of the positive pixel electrode is set to a voltage smaller than 5V which is the minimum value in the positive pixel voltage range (5 to 10V, for example), more preferably, to 7.5 V, which is equal to or larger than half the positive pixel voltage range when the negative common voltage Vcom-n (−20V, for example) is applied to the common electrode is also applicable.

(4-2) Modification 2

In the second embodiment, the dot inversion drive in which the polarity is inverted on a pixel to pixel basis is applied during the initial transition time. However, the invention is not limited thereto, and the areas each including a plurality of pixels may be defined to invert the polarity on an area to area basis.

(4-3) Modification 3

Figure 12:
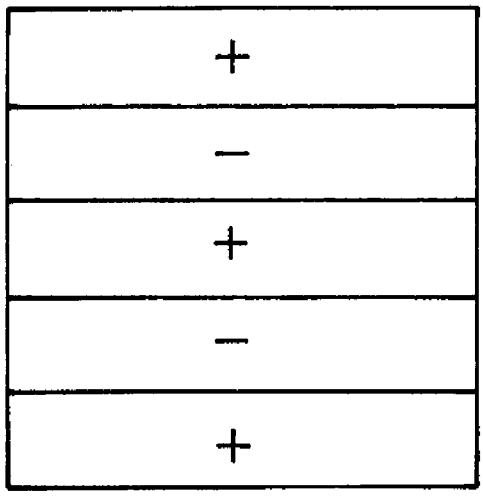
FIG. 12 is an explanatory drawing showing the state of inversion of the polarity on a line to line basis.

The operation during the image display period may be achieved by a column inversion drive in which the polarity is inverted on a column to column basis as shown in FIG. 11, or by a line inversion drive in which the polarity is inverted on a line to line basis as shown in FIG. 12.

(Modifications)

In the second embodiment as well, the initial transition time may be varied on the basis of the panel temperature detected by the temperature sensor as in the first embodiment. Although there is one type of dummy digital video signal Data stored in the controller 30 in the embodiments shown above, one of a plurality of types of the dummy digital video signal Data may be selected according to the panel temperature detected by the temperature sensor or the like.

The invention is not limited to the above-described embodiments, and various modifications may be made without departing the scope of the invention.

What is claimed is:

1. A liquid crystal display apparatus comprising:

an array substrate having a plurality of pixel electrodes in a matrix;

a common electrode opposing the pixel electrode;

a display panel having an OCB liquid crystal sandwiched between the pixel electrode and the common electrode; and a drive circuit configured to apply a pixel voltage in a positive pixel voltage range, which ranges from a first reference voltage through a maximum applicable pixel voltage, and a negative pixel voltage range, which ranges from the first reference voltage through a minimum applicable pixel voltage, to the pixel electrode, and to alternately apply a positive common voltage and a negative common voltage, which are respectively larger and smaller than a second reference voltage by a predetermined amount, to the common electrode, wherein the drive circuit applies the positive common voltage to the common electrode and applies, throughout each period of applying the positive common voltage at a level larger than the second reference voltage by a predetermined amount, an alternating pixel voltage to the pixel electrode, which alternates between the first reference voltage and a pixel voltage smaller than the first reference voltage, and the drive circuit applies the negative common voltage to the common electrode and applies, throughout each period of applying the negative common voltage at a level smaller than the second reference voltage by the predetermined amount, an alternating pixel voltage to the pixel electrode, which alternates between the first reference voltage and a pixel voltage larger than the first reference voltage, wherein the pixel voltage is maintained during a transition of the common voltage from a negative common voltage to a positive common voltage;

thereby achieving initial transition of the OCB liquid crystal from a splay alignment to a bend alignment.

2. The apparatus according to claim 1, wherein said pixel voltage smaller than the first reference voltage is equal to or smaller than half the negative pixel voltage range, and said pixel voltage larger than the first reference voltage is equal to or larger than half the positive pixel voltage range.

3. The apparatus according to claim 2, wherein said pixel voltage smaller than the first reference voltage is the minimum applicable pixel voltage, and said pixel voltage smaller than the first reference voltage is the maximum applicable pixel voltage.

4. The apparatus according to claim 1, wherein the drive circuit applies a constant common voltage between the positive common voltage and the negative common voltage to the common electrode after having ended the initial transition.

5. A liquid crystal display apparatus comprising:

an array substrate having a plurality of pixel electrodes in a matrix;

a common electrode opposing the pixel electrodes;

a display panel having an OCB liquid crystal sandwiched between the pixel electrodes and the common electrode; and a drive circuit configured to apply a pixel voltage a positive pixel voltage range, which ranges from a first reference voltage through a maximum applicable pixel voltage, and a negative pixel voltage range, which ranges from the first reference voltage through a minimum applicable pixel voltage, to the pixel electrode, and to alternately apply positive common voltage and a negative common voltage, which are respectively larger and smaller than a second reference voltage by a predetermined amount, to the common electrode, wherein the drive circuit applies the positive common voltage to the common electrodes and applies, throughout each period of applying the positive common voltage at a level larger than the second reference voltage by the predetermined amount, an alternating pixel voltage to the pixel electrode, which alternates between the first reference voltage and a pixel voltage smaller than the first reference voltage, and the drive circuit applies said alternating pixel voltage having a phase opposite to that for said one of the pixel electrodes during the application of the positive common voltage, to another one of the pixel electrodes which is adjacent to the one of the pixel electrodes, wherein the pixel voltage is maintained during a transition of the common voltage from a negative common voltage to a positive common voltage;

thereby achieving initial transition of the OCB liquid crystal from a splay alignment to a bend alignment.

6. The apparatus according to claim 5, wherein the drive circuit applies the negative common voltage to the common electrode and applies, throughout said each period of applying the negative common voltage at a level larger than the second reference voltage by the predetermined amount, an alternating pixel voltage to the pixel electrode, which alternates between the first reference voltage and a pixel voltage larger than the first reference voltage to the one of the pixel electrodes, and the drive circuit applies said alternating pixel voltage having a phase opposite to that for said one of the pixel electrodes, a pixel voltage the negative pixel voltage range to said another one of the pixel electrodes, thereby achieving the initial transition of the OCB liquid crystal from the splay alignment to the bend alignment.

7. The apparatus according to claim 5, wherein said pixel voltage smaller than the first reference voltage and applied to the one of the pixel electrodes is equal to or smaller than half the negative pixel voltage range; and said pixel voltage applied to the another one of the pixel electrodes is equal to or smaller than half the positive pixel voltage range.

8. The apparatus according to claim 5, wherein said pixel voltage smaller than the first reference voltage and applied to the one of the pixel electrodes is the minimum applicable pixel voltage; and said pixel voltage applied to the another one of the pixel electrodes is the minimum applicable pixel voltage.

9. The apparatus according to claim 8, wherein the one of the pixel electrodes and the another one of the pixel electrodes are arranged adjacently in the row direction.

10. The apparatus according to claim 8, wherein the one of the pixel electrodes and the another one of the pixel electrodes are arranged adjacently in the column direction.

11. The apparatus according to claim 5, wherein the drive circuit applies a constant common voltage between the positive common voltage and the negative common voltage to the common electrode after having ended the initial transition.

12. The apparatus according to claim 5, including a backlight laminated on the display panel, wherein the drive circuit extinguishes the backlight during the initial transition.

* * * * *